US007671268B2

(12) United States Patent
Nicoll

(10) Patent No.: US 7,671,268 B2
(45) Date of Patent: Mar. 2, 2010

(54) INTERNALLY MOUNTED SELF-CONTAINED AMPLIFIER AND SPEAKER SYSTEM FOR ACOUSTIC GUITAR

(76) Inventor: Laurie Victor Nicoll, Box 53, Metcalfe Post Office, Metcalfe, Victoria (AU) 3448

( * ) Notice: Subject to any disclaimer, the term of this patent is extended or adjusted under 35 U.S.C. 154(b) by 0 days.

(21) Appl. No.: 11/901,233

(22) Filed: Sep. 14, 2007

(65) Prior Publication Data

US 2009/0071317 A1 Mar. 19, 2009

(51) Int. Cl.
*H04R 1/02* (2006.01)

(52) U.S. Cl. ..... 84/718; 84/723; 84/743; 381/334

(58) Field of Classification Search ..... 84/743, 84/718; 381/334–336
See application file for complete search history.

(56) References Cited

U.S. PATENT DOCUMENTS

| | | | | | |
|---|---|---|---|---|---|
| 1,893,893 | A | * | 1/1933 | Hammond, Jr. | 181/141 |
| 1,994,889 | A | * | 3/1935 | Hammond, Jr. | 381/118 |
| 3,194,870 | A | * | 7/1965 | Tondreau et al. | 84/726 |
| 3,357,291 | A | * | 12/1967 | Carmichael | 84/267 |
| 3,696,700 | A | * | 10/1972 | Berardi | 84/291 |
| 3,733,953 | A | * | 5/1973 | Ferber | 84/724 |
| 3,781,451 | A | * | 12/1973 | Nolan | 84/723 |
| 3,796,122 | A | * | 3/1974 | Kaminsky | 84/173 |
| 3,869,952 | A | * | 3/1975 | Rowe | 84/727 |
| 3,978,941 | A | * | 9/1976 | Siebert | 181/151 |
| 4,245,540 | A | * | 1/1981 | Groupp | 84/726 |
| 4,312,258 | A | * | 1/1982 | Park | 84/743 |
| 4,394,830 | A | * | 7/1983 | Damiano | 84/726 |
| 4,464,967 | A | * | 8/1984 | Trimborn | 84/743 |
| 4,501,186 | A | * | 2/1985 | Ikuma | 84/726 |
| 4,748,886 | A | * | 6/1988 | De Byl | 84/723 |
| 5,005,461 | A | * | 4/1991 | Murata | 84/646 |
| 5,056,400 | A | * | 10/1991 | Wachi et al. | 84/600 |
| 5,086,686 | A | * | 2/1992 | Misawa et al. | 84/718 |
| 5,164,528 | A | * | 11/1992 | Arai et al. | 84/177 |
| 5,422,955 | A | * | 6/1995 | Guzman et al. | 381/77 |
| 5,438,157 | A | * | 8/1995 | Lace et al. | 84/726 |
| 5,438,158 | A | * | 8/1995 | Riboloff | 84/727 |
| H1503 | H | * | 12/1995 | Threadgill | 84/723 |
| 5,883,322 | A | * | 3/1999 | Baker | 84/453 |
| 5,929,362 | A | * | 7/1999 | Oteyza | 84/743 |
| 6,018,119 | A | * | 1/2000 | Mladek | 84/722 |
| 6,191,350 | B1 | * | 2/2001 | Okulov et al. | 84/646 |
| 6,441,292 | B1 | * | 8/2002 | Donnell | 84/723 |
| 6,528,708 | B2 | * | 3/2003 | Konishi et al. | 84/177 |
| 6,800,797 | B2 | * | 10/2004 | Steiger, III | 84/267 |
| 7,015,390 | B1 | * | 3/2006 | Rogers | 84/723 |
| 7,247,789 | B2 | * | 7/2007 | Fishman et al. | 84/723 |
| 2001/0055406 | A1 | * | 12/2001 | Geiger | 381/334 |
| 2002/0114481 | A1 | * | 8/2002 | Watanabe | 381/334 |
| 2003/0154842 | A1 | * | 8/2003 | Steiger | 84/267 |
| 2004/0244566 | A1 | * | 12/2004 | Steiger | 84/610 |
| 2005/0252363 | A1 | * | 11/2005 | Rockett | 84/723 |

(Continued)

*Primary Examiner*—David S. Warren
(74) *Attorney, Agent, or Firm*—Michael A. Guth

(57) ABSTRACT

An apparatus for the amplification and projection of the sound of a musical instrument, such as an acoustic guitar, adapted to mount within the guitar itself. The apparatus may mount within the sound hole of the guitar, with an outward facing speaker within the sound hole adapted to project the sound of the instrument. The apparatus may have an amplifier attached to the speaker in a unitary design. The apparatus may be battery powered.

17 Claims, 16 Drawing Sheets

U.S. PATENT DOCUMENTS

2006/0000346 A1* 1/2006 Bellak ..... 84/741
2006/0000347 A1* 1/2006 Preece ..... 84/741
2006/0156913 A1* 7/2006 Fishman et al. ..... 84/743
2007/0180975 A1* 8/2007 Paris et al. ..... 84/291
2008/0072747 A1* 3/2008 Nishida ..... 84/744
2008/0156180 A1* 7/2008 Bagale ..... 84/743
2008/0184864 A1* 8/2008 Holt et al. ..... 84/267

* cited by examiner

INTERNALLY MOUNTED SELF-CONTAINED AMPLIFIER AND SPEAKER SYSTEM FOR ACOUSTIC GUITAR

BACKGROUND

1. Field of the Invention

This invention relates to music, and more specifically to a system for amplifying an acoustic instrument, such as a guitar, using an internally mounted amplifier and speaker system that may be battery operated.

2. Description of Related Art

Musical instrument amplifiers are used to increase the acoustic volume of a performance of a musical instrument in a manner that produces sound faithful to the original instrument for the purpose of enabling the performance to be better heard.

Generally, a plucked string instrument such as a guitar is structured so that both ends of a plurality of strings are fixed to an instrument main body constituted of a body and a neck, and a bridge is sandwiched by the strings and a top of the instrument main body. A plucking operation of plucking the strings between the bridge and a nut on the neck with fingers produces musical sound. The bridge, in the case of a guitar, if fixedly attached to the top of the main body.

With an electric guitar, a magnetic pickup device that electrically detects the vibration of the steel strings by an induction effect allows for sensing, and then the amplification of, the vibration of the strings. With an acoustic instrument, the amplification typically is based upon the use of a microphone. With acoustic electric guitars, the guitar appears to be an acoustic instrument, but is wired with a pickup, typically within the bridge, that translates the vibrations into an electrical signal, often using a piezo effect.

Electric guitars and acoustic guitars and the music they produce are well known. Electric guitars are used with external speakers and amplifiers. When used in live performances in relatively large areas, the sound of an acoustic guitar is also amplified. Recent years have seen a demand for the faithful detection of the raw sound particular to acoustic instruments. In addition, often the need for amplification falls into a lower category that does not require large speakers and high power amplifiers.

What is called for is an amplification system for acoustic electric instruments that allows for increased volume and amplification without the use of large external amplifiers and speakers. What is also called for is such a device that can be as easily installed as guitar strings. What is also called for is such a system that does not constrain the user without physical connection to a stationary amplifier system.

SUMMARY

An apparatus for the amplification and projection of the sound of a musical instrument, such as an acoustic guitar, adapted to mount within the guitar itself. The apparatus may mount within the sound hole of the guitar, with an outward facing speaker within the sound hole adapted to project the sound of the instrument. The apparatus may have an amplifier attached to the speaker in a unitary design. The apparatus may be operated by a battery pack.

DETAILED DESCRIPTION

Figure 1:
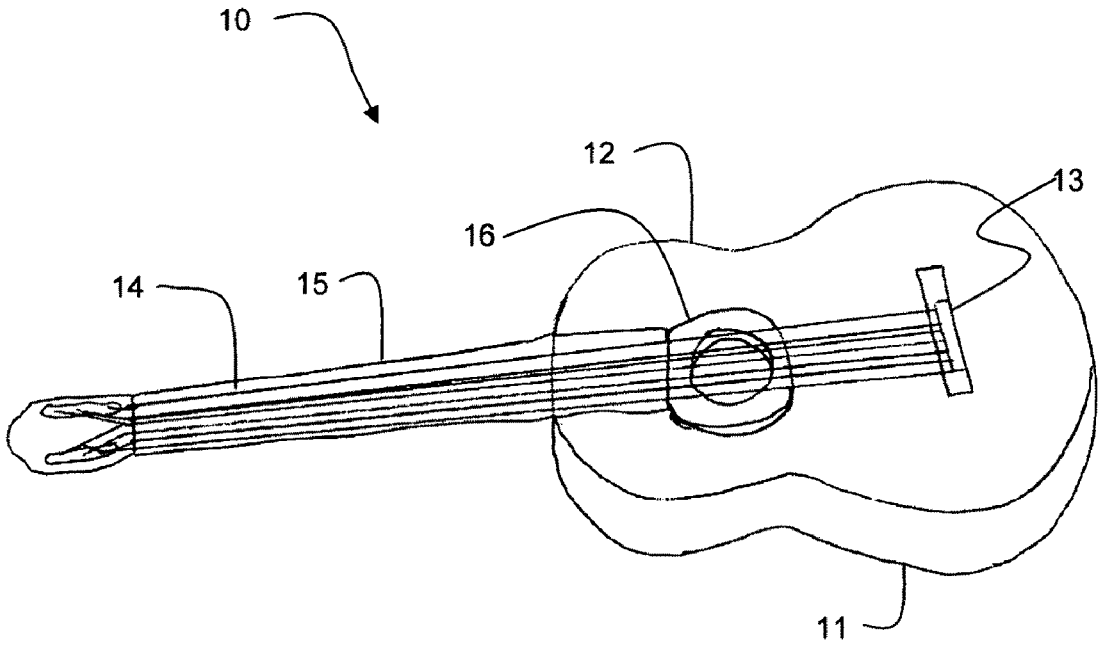
FIG. 1 is a sketch of guitar with an internally mounted system according to some embodiments of the present invention.

In some embodiments of the present invention, as seen in FIG. 1, an amplified guitar system 10 with a sound enhancing unit 16 is mounted within the sound hole of a guitar 12. The guitar may be an acoustic electric guitar, with strings 14 extending along the neck 15 and across the main body 11 of the guitar 12 to the bridge 13. In the example of an acoustic electric guitar, the guitar may not use pickups mounted into the guitar under the strings in the middle of the main body 11, but instead may have a pickup mounted within the bridge 13. The pickups may be of a piezoelectric type. Typically, the acoustic electric guitar will have wiring within the guitar body running from the pickups to a jack somewhere on the main body 11 adapted to provide input to an amplifier. With the example of an acoustic electric guitar, the guitar is adapted to play with or without external amplification, as the instrument has a hollow body and a sound hole in the main body, and is adapted to project sound to some extent. The system provides a self-contained guitar and amplifier system. The sound enhancing unit is adapted not to effect the acoustic performance of the guitar. The system need not be mounted in any permanent fashion and allows for easy removal as well as easy installation.

Figure 2:
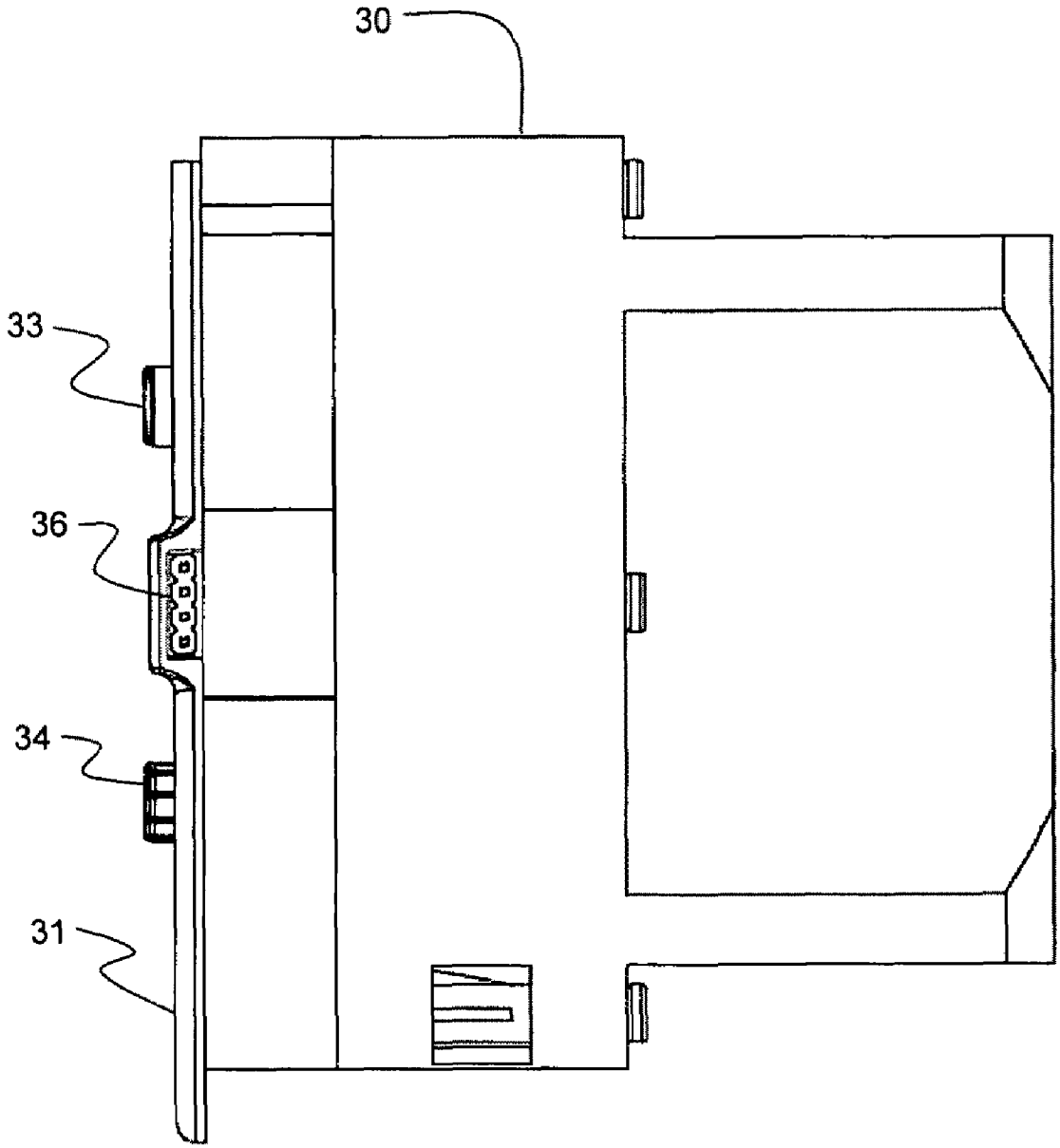
FIG. 2 is a side view of an amplification system according to some embodiments of the present invention.

FIG. 2 illustrates a side view of a sound enhancing unit 30 adapted to mount within the sound hole of the guitar with its front surface 31 just below the strings of the guitar and the unit itself mounted inward into the main body of the guitar according to some embodiments of the present invention. An electric plug 36 is mounted to the sound enhancing unit 30 such that the plug is accessible from the outside of the guitar when the sound enhancing unit 30 is mounted within the guitar. The electric plug may interface with an external power supply in some embodiments. The external plug may interface with the output of the guitar in some embodiments. A power on/off switch 33 is seen which is used to turn on the sound enhancing unit 30. A volume knob 34 is seen. The control features are adapted to keep a low profile to minimize the likelihood of interference with the guitar strings or the hands of the player.

Figure 3:
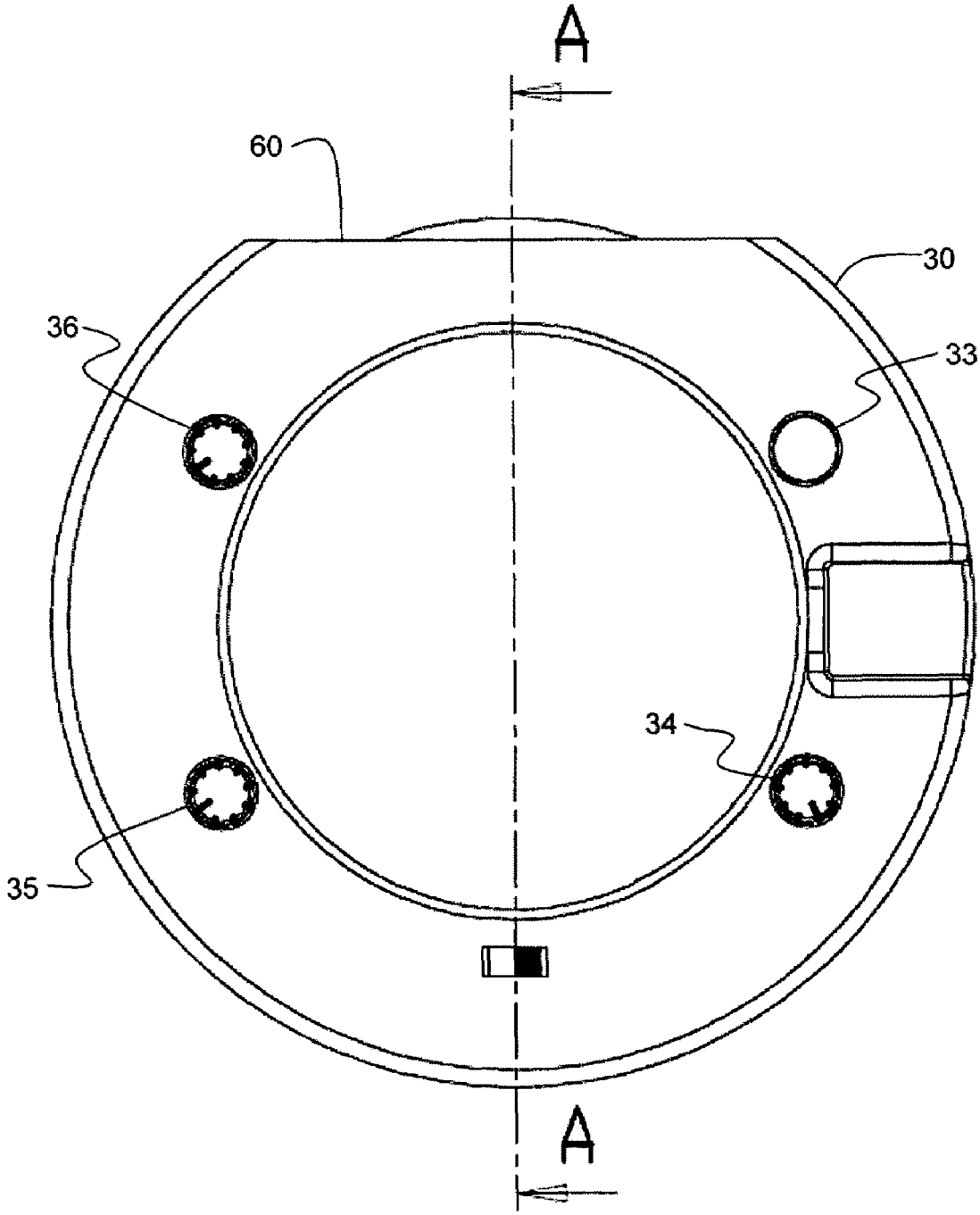
FIG. 3 is a front view of an amplification system according to some embodiments of the present invention.

FIG. 3 illustrates a front view of a sound enhancing unit according to some embodiments of the present invention. The outer periphery 30 of the front surface 31 is designed to be somewhat larger than the typical range of guitar sound hole diameters such that when the sound enhancing unit is placed into the sound hole of the guitar, the outer periphery 30 of the front surface 31 prevents the sound enhancing unit from fully entering into the guitar and dropping into the main body. The typical range of sound hole diameters is 97-104 mm. A flat surface 60 along the top of the front surface 31 of the sound enhancing unit is adapted to fit guitars where the neck and fret board have a straight end that projects somewhat into the sound hole, or into the area that a circular sound hole would have taken. A treble level knob 35 and a bass level knob 36 may be present in some embodiments. A unit on indication light may be present in some embodiments.

In some embodiments, the unit may also be adapted to allow the user to select an amplification level based upon whether the guitar has a pre-amplifier. The unit may have a switch on its front face that allows the user to switch between a pre-amp mode or a bypass mode.

Figure 4:
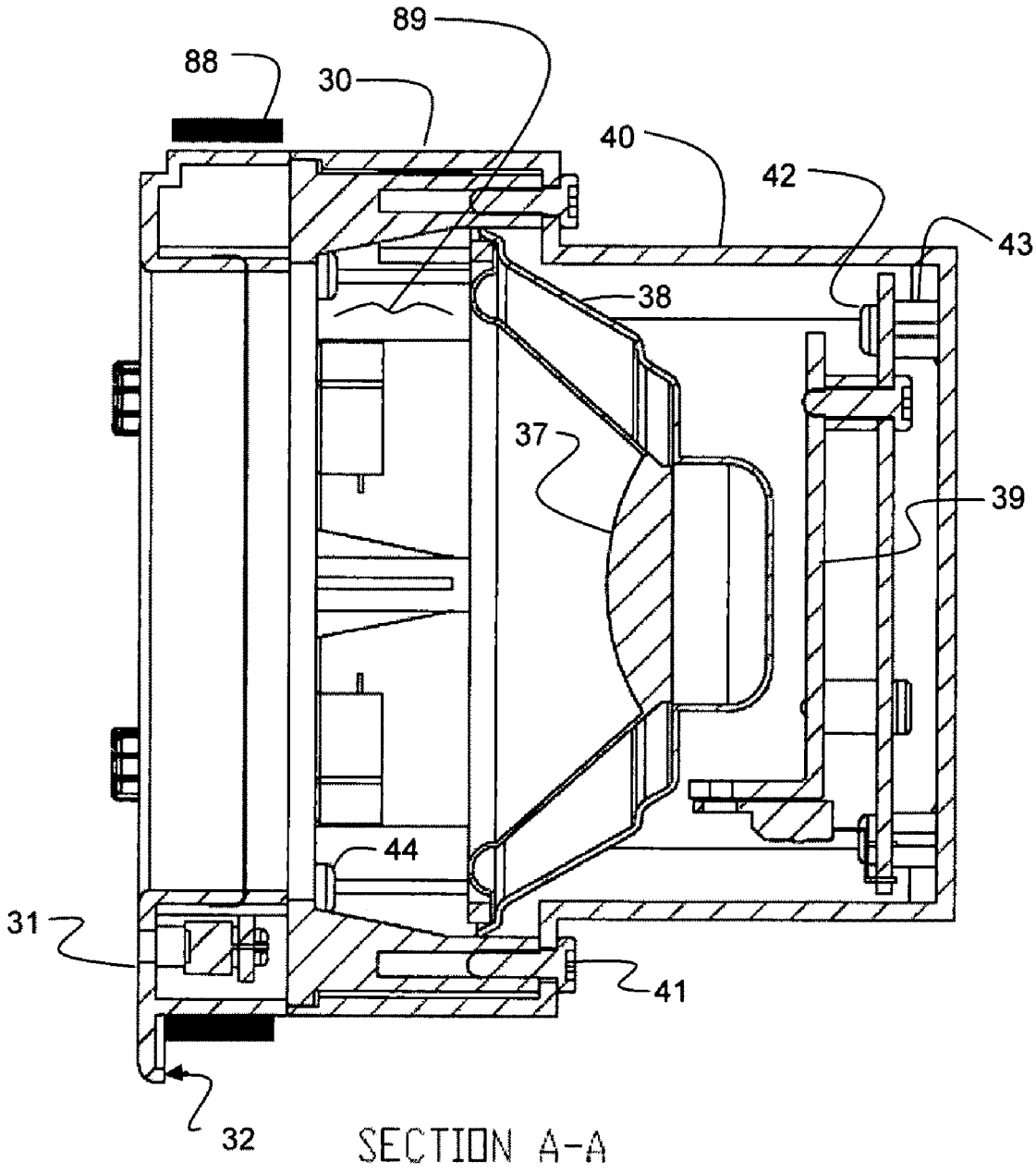
FIG. 4 is a cross-sectional view of an amplification system according to some embodiments of the present invention.
Figure 5:
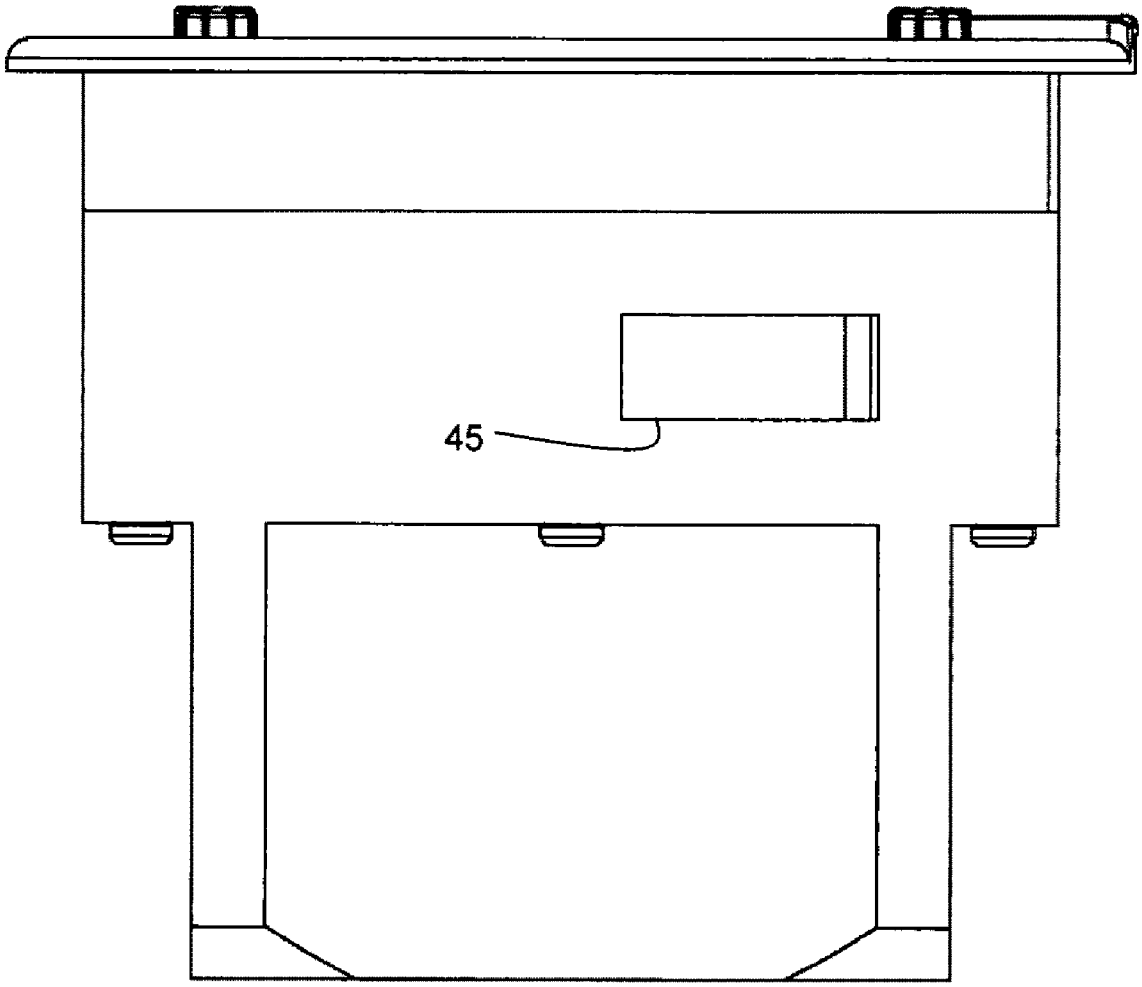
FIG. 5 is a bottom view of an amplification system according to some embodiments of the present invention.

FIG. 4 is a cross-sectional view of a sound enhancing unit 30 according to some embodiments of the present invention. The front surface 31 of the sound enhancing unit will be facing outwards from the guitar when the sound enhancing unit 30 is installed within the guitar. The lip 32 underneath the outer periphery of the front surface 32 will be engaged with or close to the surface of the guitar main body.

A grip ring 88 is mounted onto the body of the unit just below the lip 32. The grip ring 88 may of a rubberized material and is ductile to allow the tighter fit of the unit into the sound hole as the unit 30 is pushed down into the sound hole. The grip ring 88 allows for the unit to be snugly fit into sound holes of varying diameters. The unit 30 may be firmly pressed into the sound hole until the grip ring is under compression, which will allow both a snug fit and also good hold and retention of the unit 30 by the guitar sound hole. Although the grip ring 88 has a function to enhance the fit and the snugness of the fit of the sound enhancing unit in sound holes of different diameters, the ductile nature of the grip ring also enhances the acoustic isolation of the speaker within the unit and the pickups of the guitar.

Within the sound enhancing unit 30, a speaker 37 is mounted at a distance below the front surface of the guitar. An intermediate area 89 is seen wherein there may be openings 45, 46 within the unit which may allow the natural acoustic noise of the guitar to exit through the unit 30 and out of the sound hole. The openings create a pathway from outside the main unit, within the guitar body, to an area over the speaker. In some embodiments, there may be six such openings 45. The spacer of the intermediate area 89 places the speaker deeper into the guitar and allows for the location of these openings. The depth of the intermediate area 89 may vary between 10 mm and 25 mm in some embodiments.

The main assembly of the sound enhancing unit 30 may be attached to the front portion of the unit with fasteners 44. A speaker mount 38 may be mounted to the spacer of the intermediate area and may hold the speaker in place. A rear box portion 40 may be attached to the main assembly with fasteners 41. An amplifier 39 may be mounted into the rear box portion 40 with fasteners 42 and spacer mounts 43.

Figure 6:
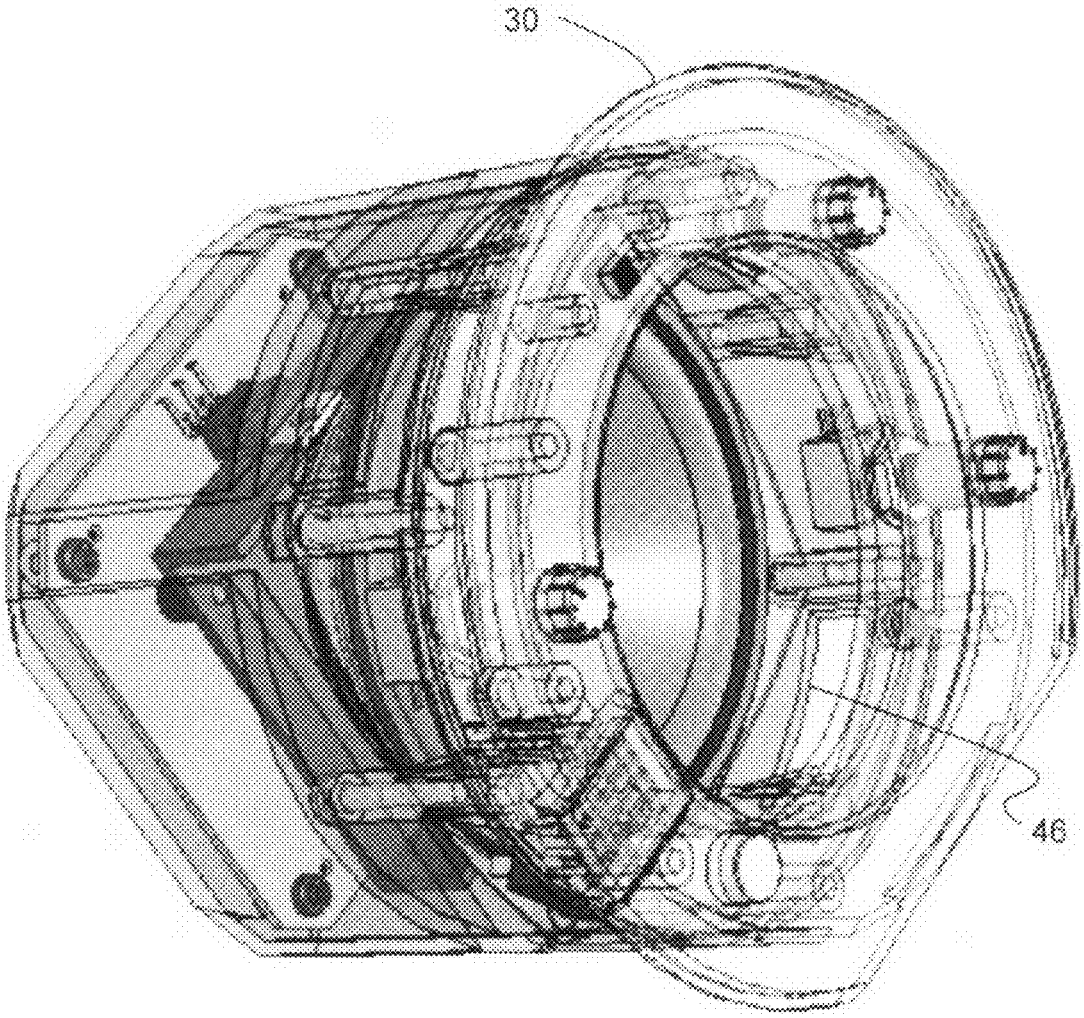
FIG. 6 is a bottom-side perspective view of an amplification system according to some embodiments of the present invention.
Figure 7:
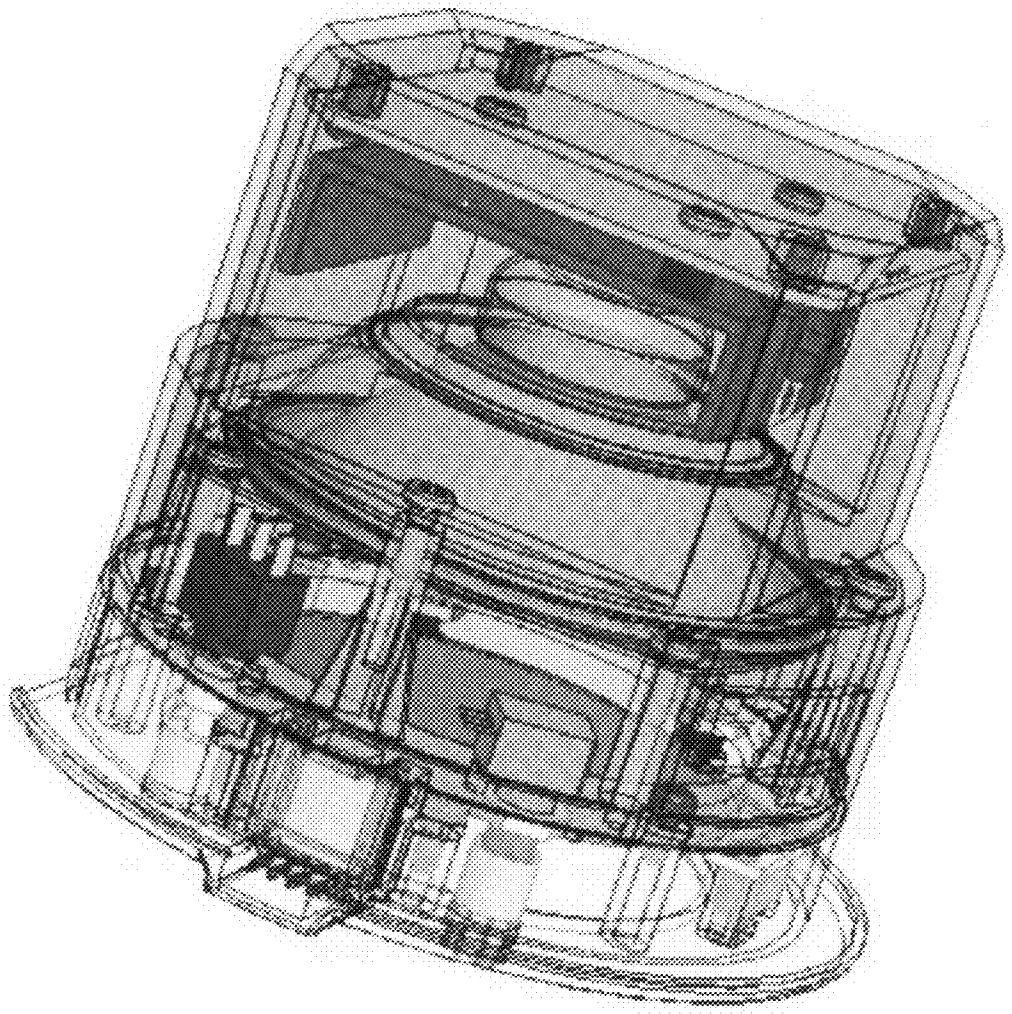
FIG. 7 is a side perspective view of an amplification system according to some embodiments of the present invention.
Figure 8:
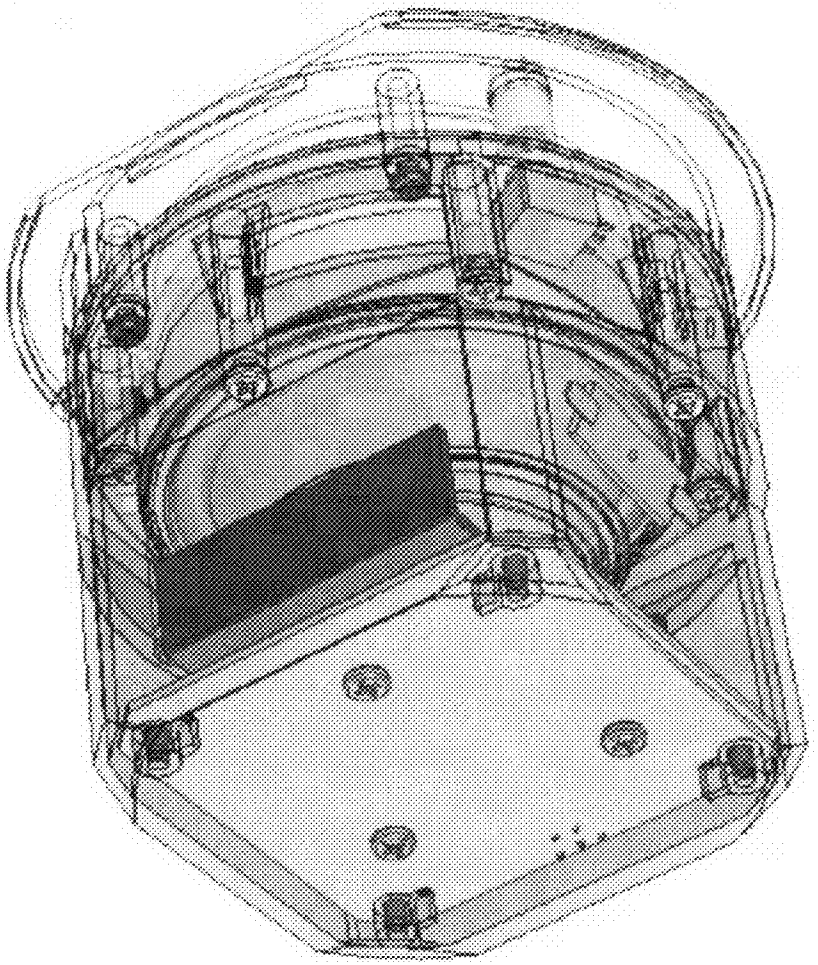
FIG. 8 is a top perspective view of an amplification system according to some embodiments of the present invention.

FIGS. 6-8 are partial see-through perspective views of a sound enhancing unit according to some embodiments of the present invention and are included to further illustrate these embodiments.

Figure 9:
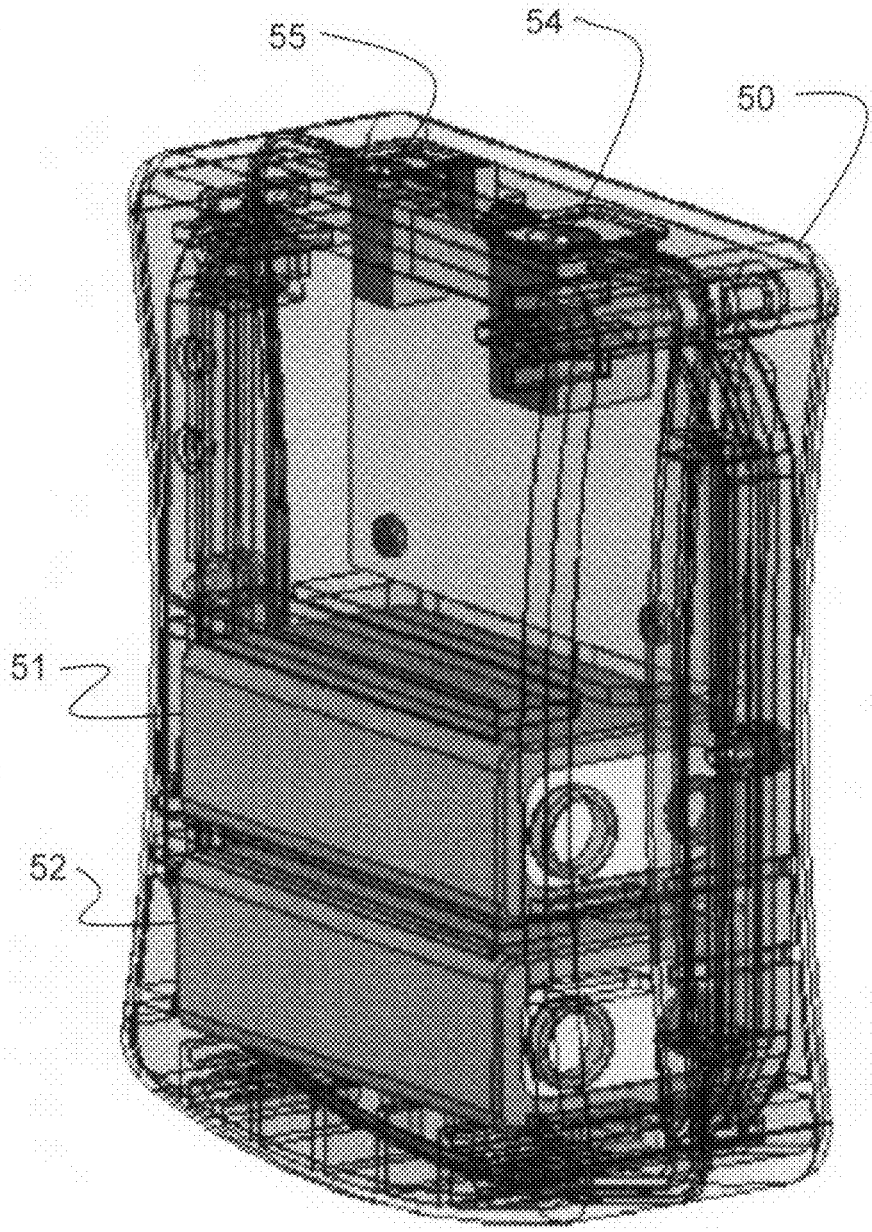
FIG. 9 is a view of an amplification system battery pack according to some embodiments of the present invention.
Figure 10:
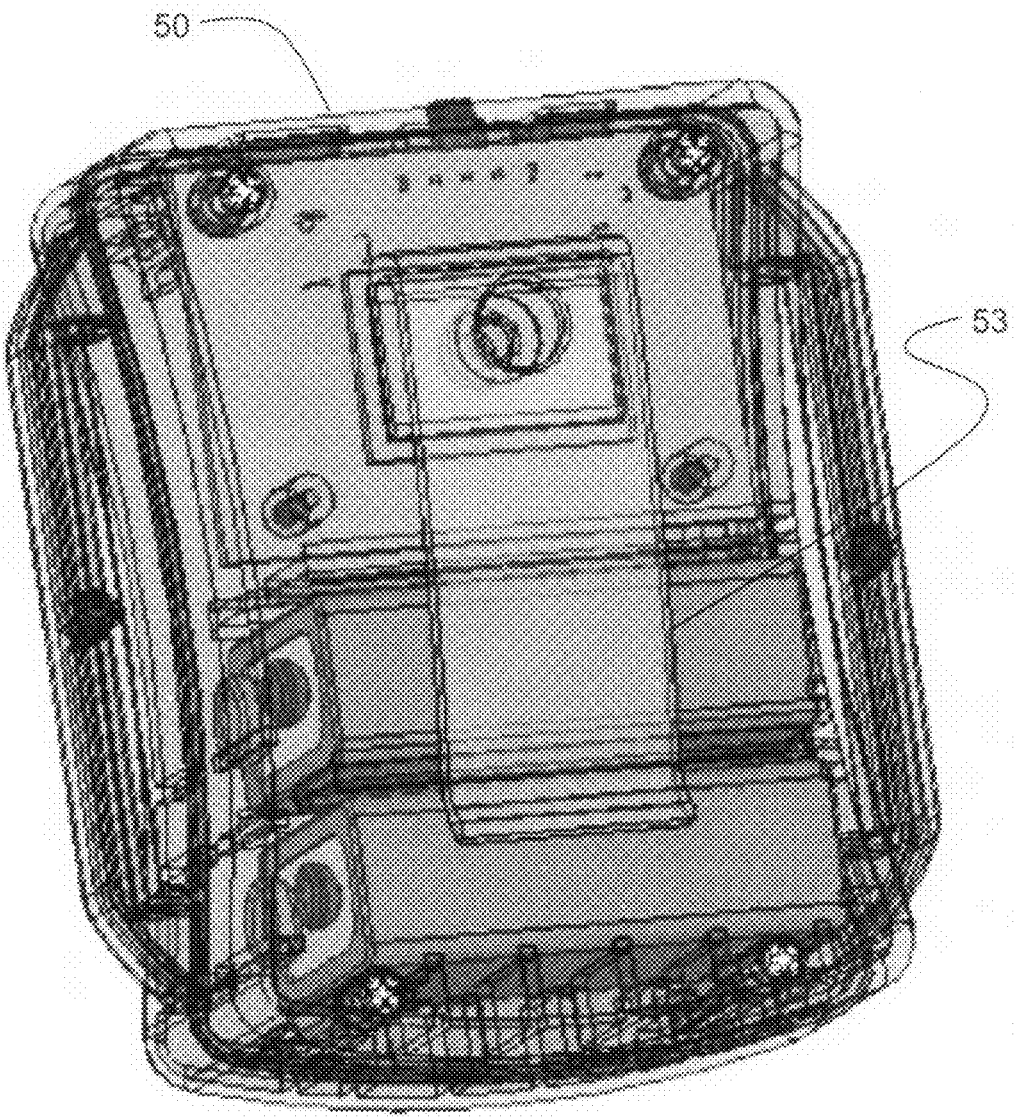
FIG. 10 is a view of an amplification system battery pack according to some embodiments of the present invention.
Figure 11A:
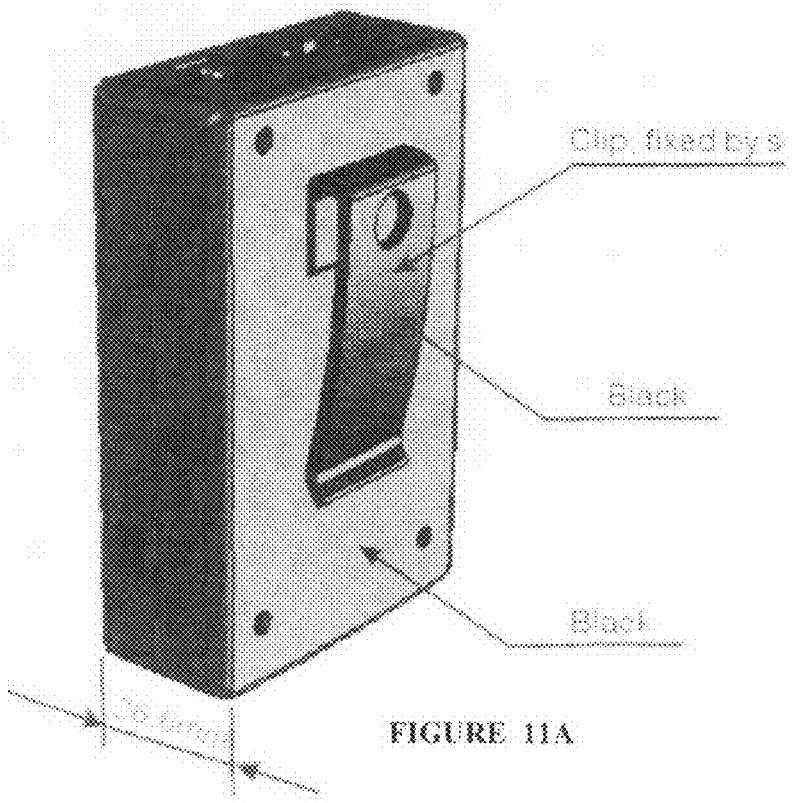
FIGS. 11A-B are views of a battery pack according to some embodiments of the present invention.
Figure 11B:
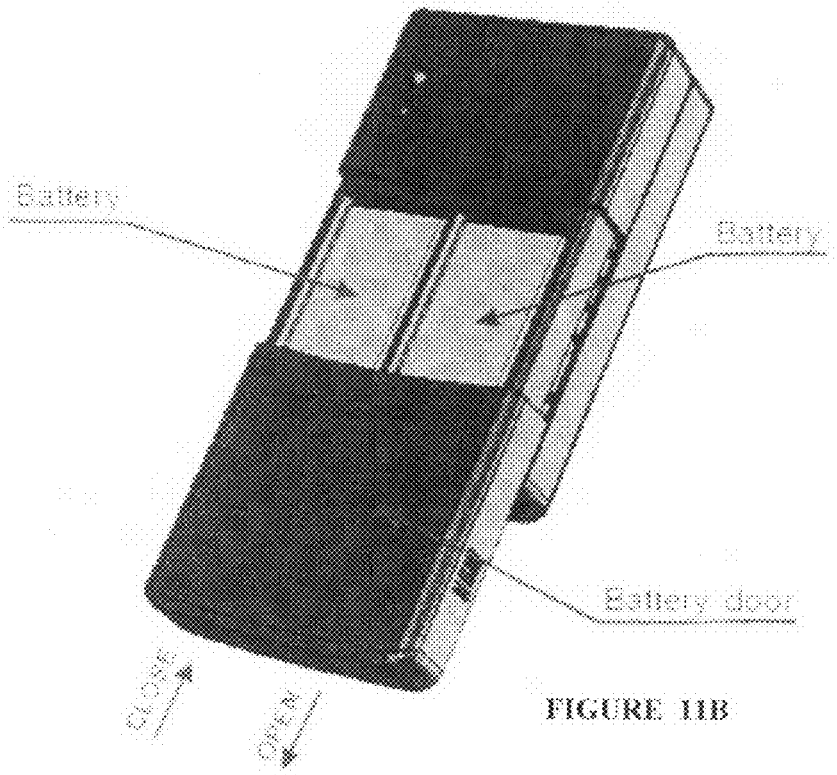

In some embodiments, the speaker and amplifier are part of an integral unit mounted within the sound hole, with an external power source outside the guitar. FIGS. 9 and 10 illustrate and external power supply 50 according to some embodiments of the present invention. The external power source 50 may be fashioned to be worn on the guitar strap, or on the belt of the user, using a strap clip 53 on the unit. External plugs 54, 55 may be used to provide power via a cable to the sound enhancing unit. One plug may also be used to recharge the batteries 51, 52 within the unit. In some embodiments, two 9 volt transistor style batteries may be used. FIGS. 11A-B illustrate another embodiment of the external power supply.

Figure 12A:
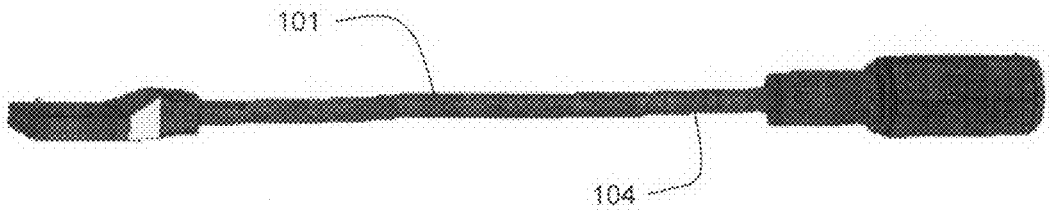
FIGS. 12A-C are views of a cord for use with the amplification system according to some embodiments of the present invention.
Figure 12B:
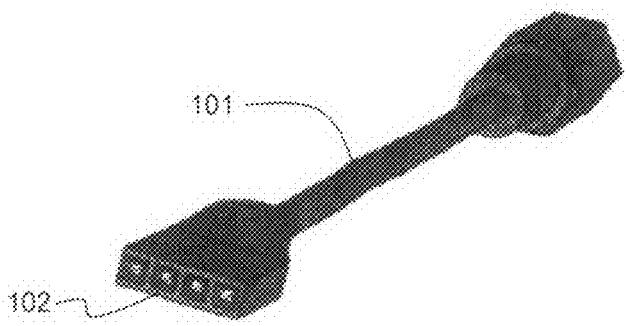
Figure 12C:
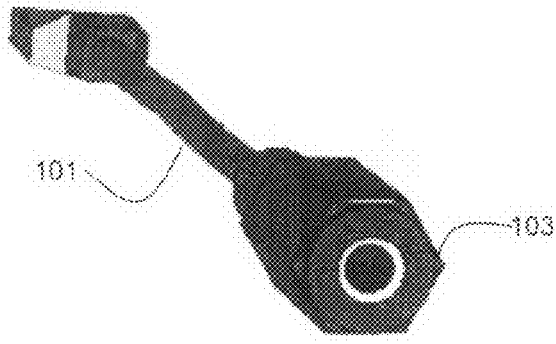
Figure 13A:
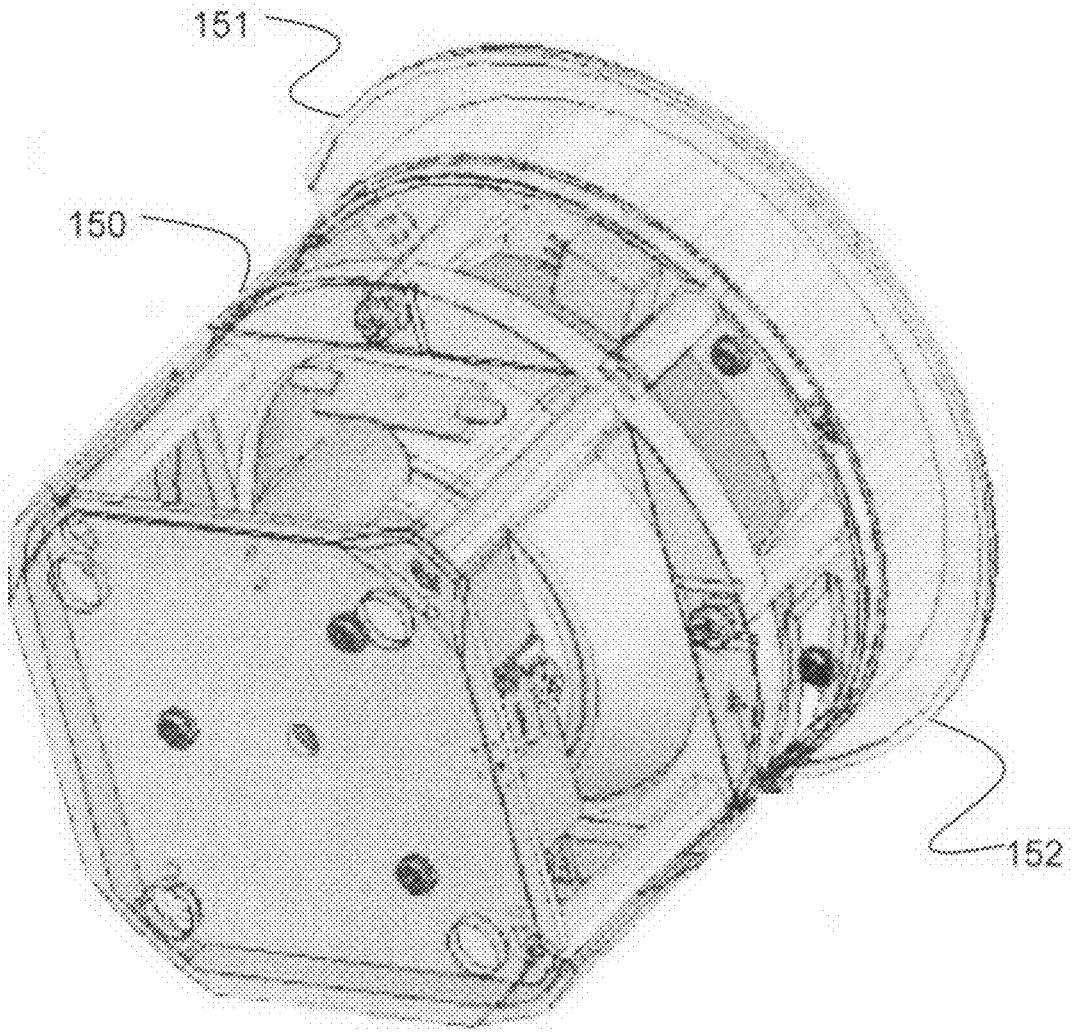
FIGS. 13A-B are perspective and cutaway view of a system according to some embodiments of the present invention.
Figure 13B:
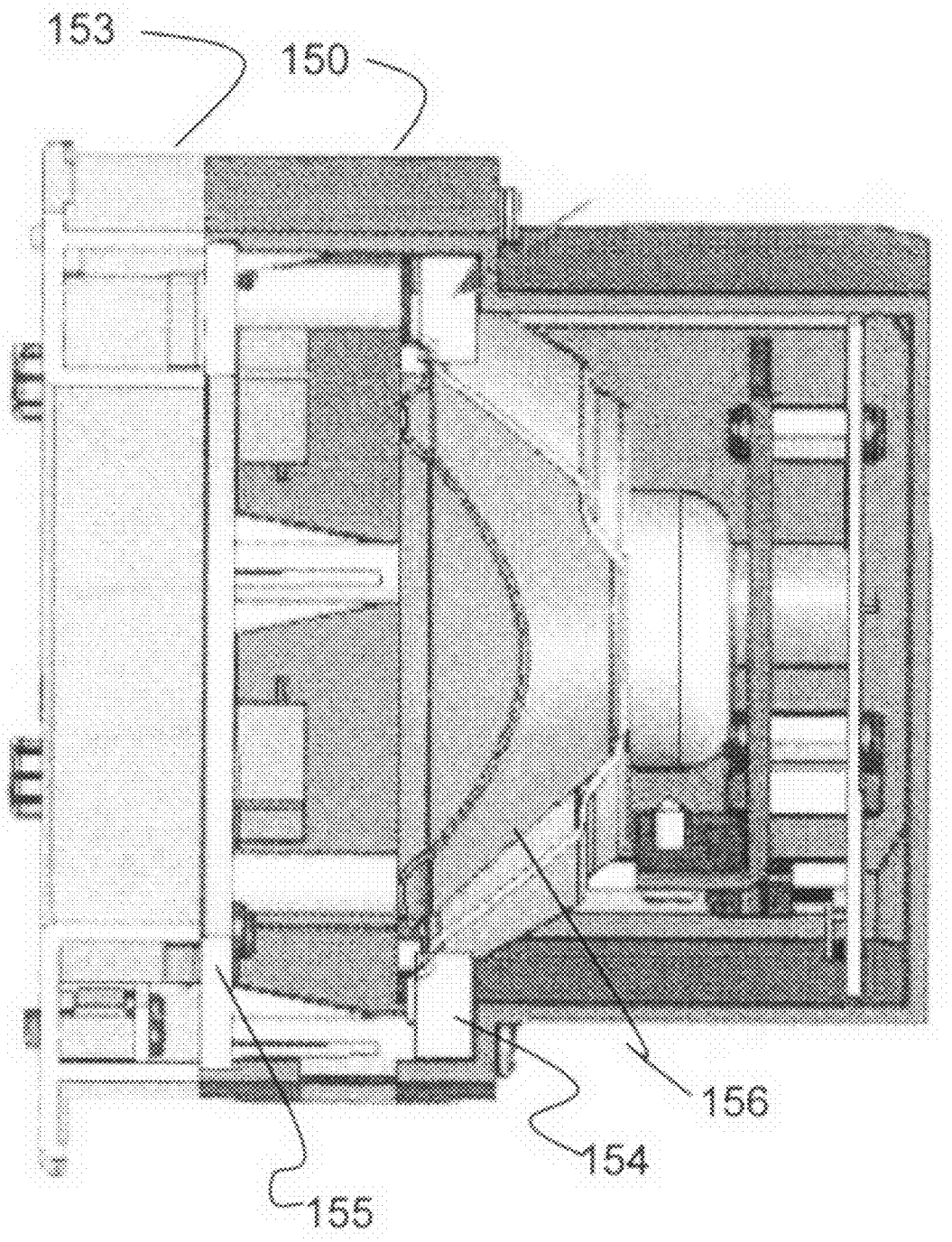

FIGS. 12A-C illustrate a patch cord 101 adapted to be used with the sound enhancing unit. With the unit mounted in the guitar, the guitar side plug 102 is adapted to plug into the unit at its interface plug 36. The second end of the patch cord 101 has a jack 103 adapted to receive a small stereo plug which is part of a cord coming from the standard exit jack of the guitar. In some embodiments, the center portion 104 of the cord 101 is flexible. In other embodiments, the center portion may be more rigid, and may be pre-shaped into a dog leg, or bent, orientation which may reduce the likelihood of the patch cord and its mating cord from interfering with the user.

In some embodiments, the power source may be mounted on or within the guitar body. In some embodiments, the power source may be integrated into the sound enhancing unit itself. In some embodiments, the speaker may be affixed to the sound hole as in other embodiments, but the amplifier may reside at another location.

The installation of the sound enhancing unit may be as follows. The strings, if installed on the guitar, would be removed. In some applications, the wire leads from the pickups of the acoustic electric guitar would be disconnected from the external jack on the guitar body and instead attached to the sound enhancing unit. This direct connection is not required and the user may instead use the patch cord as discussed above. The sound enhancing unit would then be placed down into the sound hole of the guitar until snug. The strings would then be replaced onto the guitar. The power supply is then connected to the sound enhancing unit using a wire cable to the flush mounted jack on the sound enhancing unit. The unit may then be turned on and played.

A sound enhancing unit according to the embodiments of this disclosure may allow for a 3-6 dB enhancement of the volume of the guitar. This may be ideal for situations wherein that guitar is to be played and a somewhat enhanced volume is desired.

FIGS. 13A-B and 14A-B illustrate a sound enhancing unit 150 according to some embodiments of the present invention. A central support portion 155 is attached to a mounting portion 152 adapted to mount the unit to the circular rim of the sound hole of a guitar. The mounting portion 152 may have a lip 151 adapted to reside on the outer portion of the rim of the sound hole of a guitar. The mounting portion 152 may have a ring 153 of ductile material to enhance the grip on the unit to the sound hole of the guitar. The speaker 156 may be attached to the central support portion 155 using a standoff 157 as an isolator. In some embodiments, the standoff 157 is of an EVA foam. In some embodiments, the standoff 157 is a circular element which has holes or slots within it that allow for mounting, or grabbing, of elements mounted to central support portion.

Figure 14A:
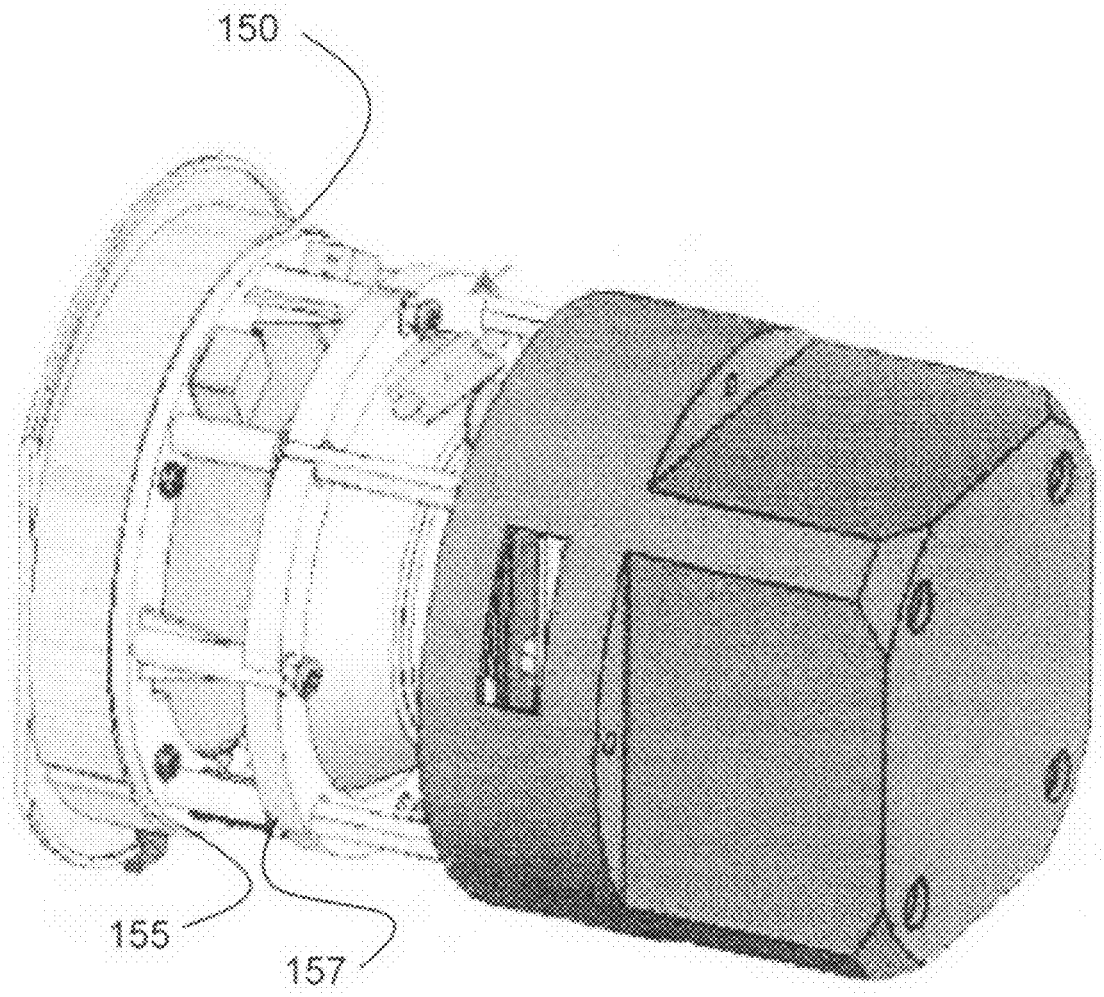
FIGS. 14A-B are an exploded and perspective view of a system according to some embodiments of the present invention.
Figure 14B:
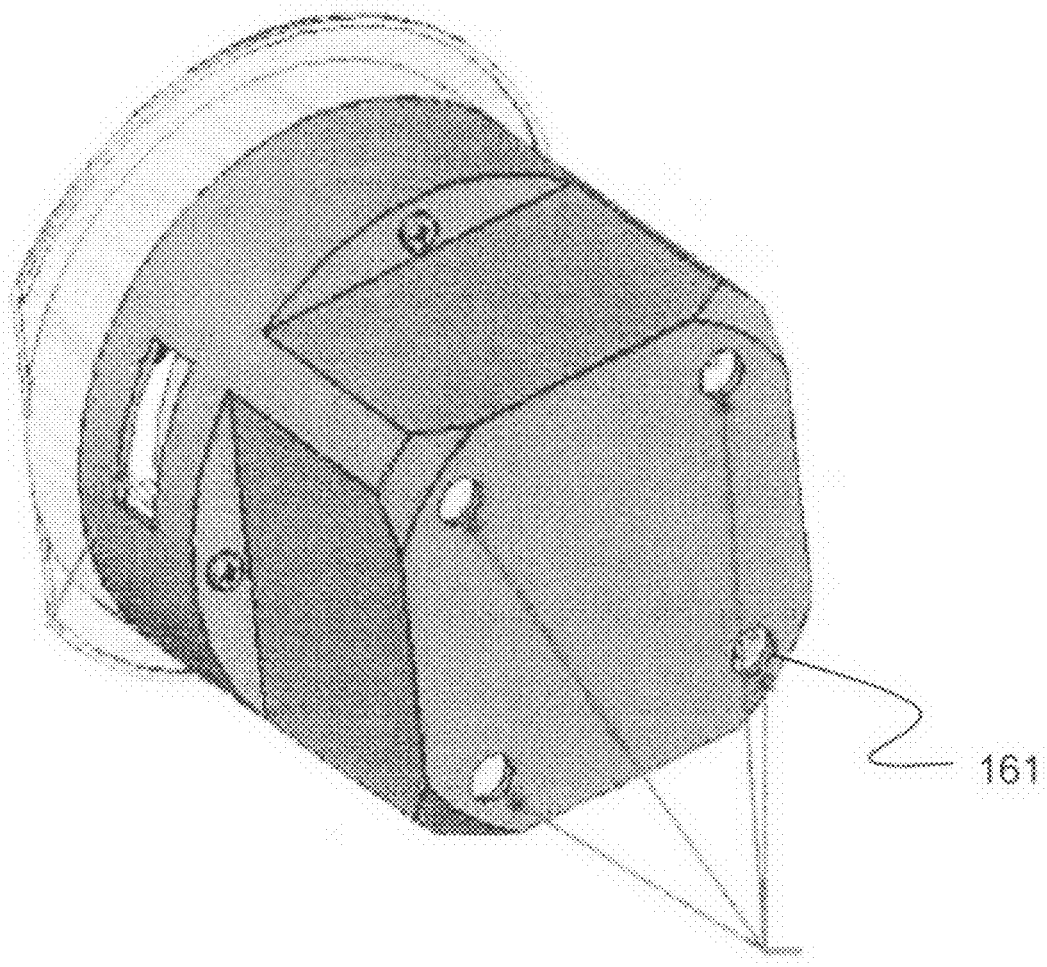

FIG. 14A illustrates a rear cover 160 adapted to cover the rear of the unit. The rear cover 160 may have rear openings 161 which may enhance the sound resonance within the guitar. In some embodiments, the unit may have both the openings 45, 46 and the rear openings 161. In some embodiments, there may be only the rear openings 161. In some embodiments, there may be only the openings 45, 46.

As evident from the above description, a wide variety of embodiments may be configured from the description given herein and additional advantages and modifications will readily occur to those skilled in the art. The invention in its broader aspects is, therefore, not limited to the specific details and illustrative examples shown and described. Accordingly, departures from such details may be made without departing from the spirit or scope of the applicant's general invention.

I claim:

1. A sound enhancing apparatus for a guitar, said apparatus comprising:

a mounting portion adapted to mount said apparatus to the circular rim of the central sound hole of a guitar; and a central support portion attached to said mounting portion; and a speaker attached to said central support portion, wherein said mounting portion is adapted to be frictionally mounted to said central sound hole of said guitar; and wherein said central support portion comprises a second hole, said second hole through said central support portion from a first area on the external periphery of said central support portion through to a second area overlaying said speaker.

2. The sound enhancing apparatus of claim 1 wherein said mounting portion comprises a lip, said lip parallel to a first plane.

3. The sound enhancing apparatus of claim 2 further comprising a rear cover, said rear cover attached to said sound enhancing unit, said rear cover covering said speaker and said central support portion.

4. The sound enhancing apparatus of claim 3 wherein said mounting portion further comprises an annular ring, said ring underneath said lip, wherein the axis of said annular ring is substantially perpendicular to said first plane.

5. The sound enhancing apparatus of claim 4 wherein annular ring is substantially cylindrical.

6. The sound enhancing apparatus of claim 4 further comprising an amplifier mounted to said central support portion.

7. The sound enhancing apparatus of claim 4 wherein said lip is adapted to overlay the rim of said central sound hole, and wherein said apparatus is adapted to reside within said central sound hole when said lip overlays the rim of said central sound hole.

8. The sound enhancing apparatus of claim 2 wherein said mounting portion comprises a top surface, said top surface comprising a first hole, said first hole overlaying said speaker.

9. The sound enhancing apparatus of claim 6 further comprising a rear cover, said rear cover having an inside and an outside, said rear cover covering said amplifier, said speaker, and said central support portion.

10. The sound enhancing apparatus of claim 9 wherein said rear cover comprises a plurality of holes, said plurality of holes through from the outside of said rear cover through said rear cover to an area overlaying said speaker.

11. The sound enhancing apparatus of claim 6 further comprising an electrical connector, said electrical connector electronically connected to said amplifier.

12. The sound enhancing apparatus of claim 11 wherein said electrical connector is mounted along said lip of said mounting portion.

13. The sound enhancing apparatus of claim 9 wherein said rear cover comprises one or more rear holes, said rear holes through from the outside of said rear cover to a second area behind said speaker.

14. The sound enhancing apparatus of claim 10 wherein said rear cover comprises one or more rear holes, said rear holes through from the outside of said rear cover to said cover to a second area behind said speaker.

15. The sound enhancing apparatus of claim 5 wherein said annular ring comprises a ductile material.

16. The sound enhancing apparatus of claim 15 wherein said annular ring comprises a rubberized material.

17. The sound enhancing apparatus of claim 15 wherein said speaker is mounted to said central support unit with a vibrational isolator.

* * * * *